US005791219A

United States Patent [19]

Öchsner

[11] Patent Number: 5,791,219

[45] Date of Patent: Aug. 11, 1998

[54] SIGNATURE PERFORATING DEVICE

[75] Inventor: Rudolf Phillip Öchsner, Beindersheim, Germany

[73] Assignee: Koenig & Bauer-Albert Aktiengesellschaft, Wurzburg, Germany

[21] Appl. No.: 531,954

[22] Filed: Sep. 21, 1995

[30] Foreign Application Priority Data

Sep. 21, 1994 [DE] Germany ..... 44 33 604.7

[51] Int. Cl.[6] ..... B26D 1/36

[52] U.S. Cl. ..... 83/331; 83/346; 83/660; 83/663; 83/934

[58] Field of Search ..... 83/332, 346, 660, 83/698.41, 934, 698.51, 698.61, 331

[56] References Cited

U.S. PATENT DOCUMENTS

| | | | |
|---|---|---|---|
| 937,331 | 10/1909 | Reed | 83/698.41 |
| 1,411,774 | 4/1922 | Engel . | |
| 1,718,164 | 6/1929 | Magune . | |
| 2,682,306 | 6/1954 | Schriber . | |
| 2,870,840 | 1/1959 | Kwitek . | |
| 2,956,465 | 10/1960 | Mingo | 83/660 |
| 3,228,710 | 1/1966 | Chodorowski . | |
| 3,263,547 | 8/1966 | Pfaff . | |
| 3,464,293 | 9/1969 | Svendsen . | |
| 3,590,695 | 7/1971 | Gerard | 83/660 |
| 3,686,988 | 8/1972 | Ross | 83/678 |
| 3,935,774 | 2/1976 | Craddy | 83/698.51 |
| 3,969,474 | 7/1976 | Gaug . | |
| 4,669,191 | 6/1987 | Schramm | 83/660 |
| 4,826,090 | 5/1989 | Orphall | 83/698.41 |
| 4,951,967 | 8/1990 | Michalik . | |
| 4,962,686 | 10/1990 | Boyd et al. | 83/332 |
| 5,309,804 | 5/1994 | Norris . | |
| 5,370,028 | 12/1994 | Grebe . | |
| 5,524,930 | 6/1996 | Foster et al. | 83/332 |

FOREIGN PATENT DOCUMENTS

| | | | |
|---|---|---|---|
| 0 307 891 | 1/1993 | European Pat. Off. . | |
| 2 693 403 | 1/1994 | France . | |
| 139107 | 3/1903 | Germany | 83/660 |
| 1 002 610 | 2/1957 | Germany . | |
| 2 016 599 | 10/1970 | Germany . | |
| 94/08765 | 4/1994 | Germany | 83/660 |
| 53-34116 | 4/1973 | Japan . | |
| 62-141692 | 9/1987 | Japan . | |
| 2 218 367 | 11/1989 | United Kingdom . | |
| WO91/03358 | 3/1991 | WIPO . | |

*Primary Examiner*—Kenneth E. Peterson
*Assistant Examiner*—Sean Pryor
*Attorney, Agent, or Firm*—Jones, Tuller & Cooper, P.C.

[57] ABSTRACT

A signature perforating device includes a perforating cylinder and a cooperating counter perforating cylinder. The perforating cylinder carries a perforating blade strip which is formed by a number of perforating blade elements. These elements are held in place on the perforating cylinder in a profiled blade holding strip. Individual ones of these perforating blade elements can be removed from the strip for replacement without disruption to adjacent blade elements.

8 Claims, 3 Drawing Sheets

FIG.1
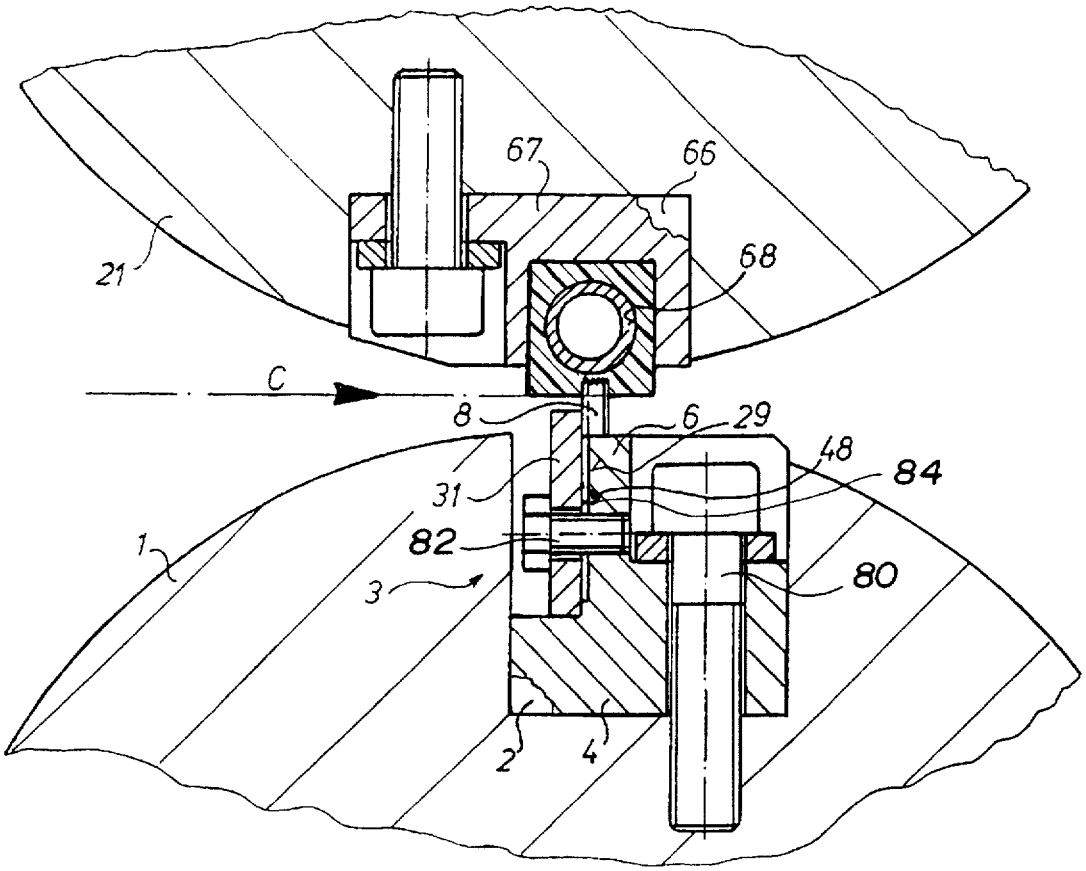
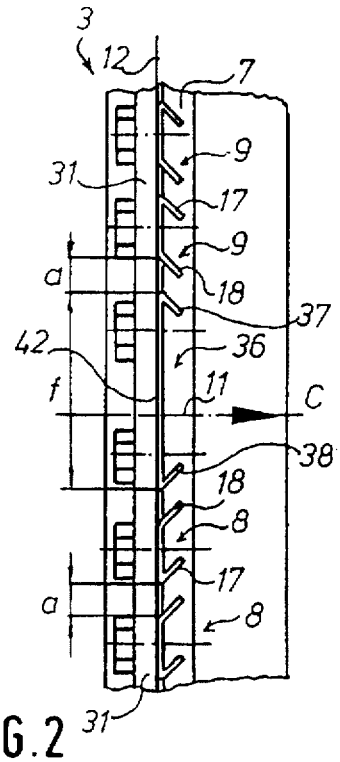
FIG.2
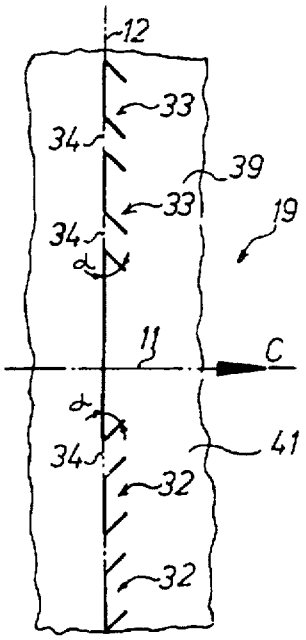
FIG. 3

SIGNATURE PERFORATING DEVICE

FIELD OF THE INVENTION

The present invention is directed generally to a signature perforating device. More particularly, the present invention is directed to a device for transversely perforating signatures along an intended transverse fold line. Most specifically, the present invention is directed to a perforating cylinder having a perforating blade strip composed of a plurality of individual perforating blade elements and to a holder for the blade elements. The perforating cylinder utilizes an elongated perforating blade holder strip which will securely grip and hold the plurality of individual perforating blade elements. These blade elements cooperate to form a perforating blade in which individual broken or bent teeth can be quickly replaced by removal of only the particular blade element from the blade holder.

DESCRIPTION OF THE PRIOR ART

In the field of rotary, web-fed printing, the printed web is led through a former and a folder where the web is cut into a plurality of web segments which are then transversely folded to form signatures. It is frequently the case that these signatures may have a large number of pages and are typically difficult to fold. It has become a well-known expedient to form a plurality of perforations or slits in the assembled plurality of web segments along what will be the transverse fold line. The formation of such a line of slits or perforations will facilitate the folding of the signatures in a more accurate and repeatable manner.

One perforating blade that is usable to perforate signatures prior to folding is shown in the European Patent Disclosure EP 0 30 7891 B1. In this disclosure, the perforating blade is provided with a plurality of perforating teeth that are positioned at a distance from each other along the length of the perforating blade. The cutting edges of the plurality of teeth in this perforating blade have a compound shape in which a base portion of each tooth is aligned with base portions of adjacent teeth and further in which legs of each tooth are disposed in an alternatingly extending relationship to each other.

This prior art perforating blade is a unitary structure. If one of the teeth should break, it means either that the entire blade must be removed and replaced or, if the blade is not replaced, that the perforations formed by the blade will be incomplete in the areas of the broken tooth or teeth.

It will be apparent that a need exists for a perforating blade arrangement that overcomes the limitations of the prior art. The signature perforating device in accordance with the present invention provides such a device and is a significant improvement over the prior art.

SUMMARY OF THE INVENTION

It is an object of the present invention to provide a signature perforating device.

Another object of the present invention is to provide a device for perforating signatures along an intended transverse fold line.

A further object of the present invention is to provide a perforating cylinder having a plurality of perforating blade elements.

Still another object of the present invention is to provide a holder for securing a plurality of individual perforating blade elements to form a perforating blade strip.

Even yet another object of the present invention is to provide a signature perforating device in which individual perforating blade elements can be removed from the holder and replaced.

Still even a further object of the present invention is to provide a signature perforating device having an increased service life.

As will be discussed in greater detail in the description of the preferred embodiment that is presented subsequently, the signature perforating device in accordance with the present invention utilizes a perforating cylinder in cooperation with a counter-perforating cylinder to form a transverse line of perforations along an intended fold line in a signature. The perforating cylinder has a perforating blade holder strip that receives and holds a plurality of individual perforating blade elements to form a perforating blade strip. Each of these elements has a group of perforating teeth with each tooth group having a straight perforating segment and one or two angled perforating segments. The straight perforating segments of all of the blade elements can be aligned along a common line extending on the periphery of the perforating cylinder generally parallel to the cylinder's axis of rotation. The angled perforating segments will be angled away from the line and will extend at an angle away from the straight perforating segments. All of the perforating blade elements are held on the surface of the perforating cylinder by a perforating blade holder strip. This holder is able to releasably hold all of the individual perforating blade elements. If one of the blade elements should have one or more of its teeth damaged or broken, that perforating blade element can be removed from the blade holder. This holder includes an elongated clamping strip and a profiled strip.

A particular advantage of the signature perforating device in accordance with the present invention is its ability to provide greatly increased service life of the perforating blade. If one or more of the blade's teeth become damaged or broken, only the individual perforating blade element containing those teeth will have to be taken out of the perforating blade holder. This can be accomplished by loosening the clamping strip portion of the holder and by pulling a tongue portion of the individual blade element out of the blade holder. A new blade element or segment can be inserted into the holder and the perforating cylinder is quickly put back into service.

The individual perforating blade elements are easily manufactured and can be combined with other or different blade elements, to provide a resultant perforating blade strip that has the desired characteristics. The spacing distances between individual perforating blade elements which make up the signatures perforating blade can also be varied, if desired. By varying the gaps between the blade elements and therefor the lengths of the bars between the slits cut by the perforating blade it is possible to match the perforating blade strip to the thickness as well as to the weight of the signatures. The perforating blade strip put together from individual perforating blade elements in accordance with the present invention is also suitable for producing a second linear fold.

The signature perforating device in accordance with the present invention overcomes the limitations of the prior art. It is a substantial advance in the art.

BRIEF DESCRIPTION OF THE DRAWINGS

While the novel features of the signature perforating device in accordance with the present invention are set forth with particularity in the appended claims, a full and complete understanding of the invention may be had by referring to the detailed description of the preferred embodiment which is presented subsequently, and as illustrated in the accompanying drawings, in which:

FIG. 1 is a cross-sectional view of a signature perforating device in accordance with the present invention and showing a perforating blade strip situated in a perforating blade holder in a perforating cylinder and cooperating with a counter strip situated in a counter-perforating cylinder;

FIG. 2 is a top plan view of a portion of the perforating blade strip of FIG. 1 in a cutaway view and showing the blade strip on both sides of a plane that linearly bisects the perforating cylinder;

FIG. 3 is a top plan view of a portion of a signature that has been transversely perforated by the perforating blade depicted in FIG. 2;

DETAILED DESCRIPTION OF THE PREFERRED EMBODIMENT

Figure 4:
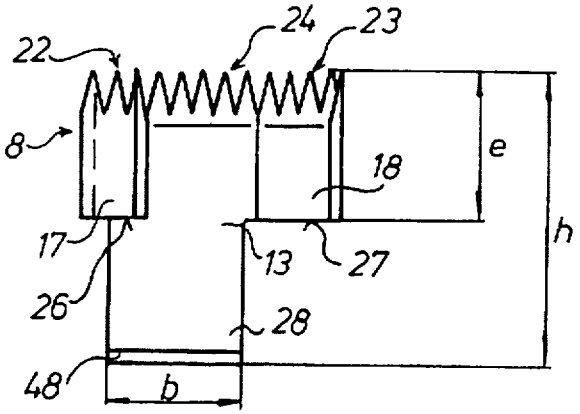
FIG. 4 is an enlarged front view of a perforating blade element used to form the perforating blade strip.

Referring initially to FIG. 1, there may be seen a folding unit of a rotary printing press which includes a perforating cylinder 1. The perforating cylinder 1 has a perforating blade strip, identified generally at 3, which is positioned in a trough 2 that extends across the cylinder 1. The perforating blade strip 3 is held in the trough 2 in a profiled blade holding strip 4 that is in the approximate shape of an inverted letter T and whose cross bar is interlockingly connected with the bottom of the trough 2 by screws 80. The blade holding strip 4 is positioned in trough 2 extending in the axial direction of cylinder 1. A plurality of individual perforating blade elements, which will be described in detail subsequently and which are each identified by 8 or 9, are disposed to the right or left of a plane 11, which linearly bisects the perforating cylinder. The plane 11 which linearly bisects the perforating cylinder 1 intersects an axis of rotation of the perforating cylinder 1 at right angles. These perforating blade elements, 8 or 9, are supported by an end 6, and in particular on a front face of the end 6, of a leg 7 of blade holding strip 4 extending vertically, i.e. in the radial direction of the perforating cylinder 1.

Figure 5:
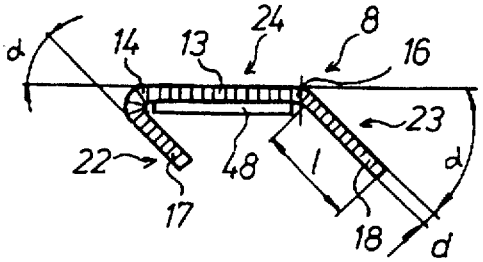
FIG. 5 is a top plan view of the individual perforating blade element of FIG. 4.

Each individual perforating blade element 8 or 9 has, as may be seen in FIGS. 4 and 5, a straight perforating segment 13 (identified as straight segment hereinafter) of a length "b" and a height "h", with length "b" extending congruently with a future transverse fold line 12 in a signature 19, as depicted in FIG. 3. An angled perforating segment 17 or 18 (identified as angled segment hereinafter) of a length "1" and a height "e" respectively extends at both ends 14, 16 of the straight segment 13 of the blade element 8 or 9. Both angled segments 17 and 18 are angled at an angle α, for example 45°, with respect to the straight segment 13, so that the free ends of the angled segments 17 and 18 respectively, point generally in the direction of the plane 11 which linearly bisects the perforating cylinder 1 and simultaneously in the transport direction of a signature 19 or in the direction of rotation C of the perforating cylinder 1. The angled segments 17 and 18, as well as the straight segment 13 of the individual perforating blade elements 8 or 9 have cutting edges 22 and 23 or a cutting edge 24, respectively on their upper sides facing a counter-perforating cylinder 21. The cutting edges can each be honed on one side or can be a finely toothed cutting edge 22 to 24. Because of a lesser height "e" of the angled segments 17 and 18 with respect to the height "h" of the straight segment 13, as is shown in FIG. 4, the undersides 26 and 27 of the angled segments 17 and 18, respectively can be supported on the end face 6 of the vertical T-leg 7, while the end or tongue 28 of the straight segment 13 of the blade element 8 or 9, which project in the amount of "h" minus "e", rests against a long side 29 of the vertical T-leg 7 of the profiled blade holding strip 4 and is clamped in place, for example by means of screws 82, by a blade clamping strip 31 extending parallel and in the axial direction with respect to the vertical T-leg 7. In this way, the individual perforating blade elements 8 and 9 can be individually distanced from each other at a as seen in FIG. 2; distance "a", as seen in FIG. 2, i.e. respectively a tooth gap corresponding to a so-called bar 34 between two cuts in the signature 19, as depicted in FIG. 3. The distance "a" can be between two and eight millimeters.

Figure 6:
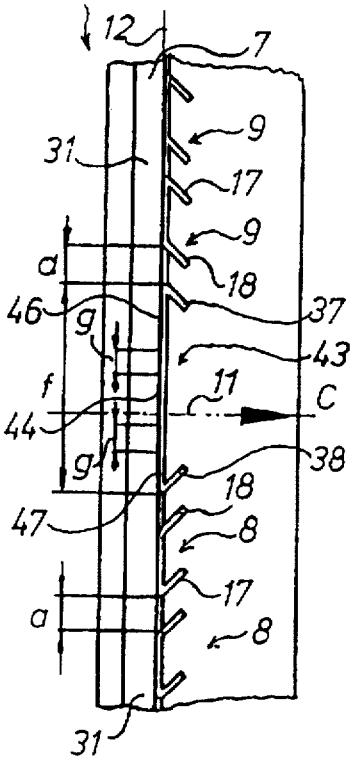
FIG. 6 is a top plan view of a portion of the perforating blade strip in the perforating cylinder of FIG. 1 generally similar to FIG. 2 and showing a different blade configuration.

The individual perforating blades 8 and 9, or center perforating blades 36 and 43, as shown in FIGS. 2 and 6, can be made of beveled steel plate of a thickness "d", for example between 0.5 and 1.5 millimeters. The individual perforating blades 8 and 9 as well as the center perforating blade elements 36 and 45 are each made of one piece. The individual perforating blade elements 8 and 9 can be arranged symmetrically or asymmetrically with respect to the plane 11 linearly bisecting the cylinder. An asymmetrical arrangement of the perforating blades 8, 9 as depicted in FIGS. 2 and 3, has the advantage, when perforating multi-layered signatures with, for example, up to 160 pages, that the bars 34 being created between the perforating cuts 32, 33 of both halves 39, 41 of the signature 19 do not come to rest on top of each other following the formation of a second longitudinal fold in the plane 11 linearly bisecting the cylinder, so that "bulging" is prevented, which otherwise is caused by the respective perforation cuts 32, 33 and the bars 34 resting on top of each other.

A center perforating blade element 36, as shown in FIG. 2, intersects the plane 11 linearly bisecting the cylinder, and has a length "f". This center perforating blade element 36 consists of a straight segment 42, and angled segments 37 and 38 that are angled at an angle α with respect to the straight element 42. The angled segments 37 and 38 point in the direction of the plane 11 linearly bisecting the cylinder and in the direction of rotation C of the perforating cylinder 1.

It is also possible to provide a center perforating blade element 43, such as is shown in FIG. 6, which is made of several parts, for example three, and whose segments are respectively designed to be displaceable or so they can be lined up. These segments can include a center straight segment 44 and a first outer straight segment 46 with an angled segment 37 angled at an angle α and a second outer straight segment 47 with an angled segment 38 angled at an angle α, the same as was previously discussed in connection with the already described individual center perforating blade element 36. The straight elements 44, 46, 47 are each disposed at a distance "g" from each other which is less, i.e. corresponds to up to 0.8 times the distance "a" between the individual perforating blade elements 8 or 9.

It is obvious that the right or left individual perforating blade elements 8 and 9 will extend lined up with each other over the entire length of the perforating blade strip 3. It is furthermore obvious that cutting edges, in particular finely toothed cutting edges are disposed on each one of the straight elements and the angled elements.

It is particularly advantageous if the downwardly extending tongue or end 28 of blade element 8 or 9 that is located opposite the cutting edge 24 of the straight segment 13 is embodied with a bead 48 extending in the axial direction of the perforating cylinder 1. This bead 48 can interlockingly enter a groove 84 in the vertical T-leg 7 of the profiled strip 4, so that the individual perforating blade 8, which is shown most clearly in FIGS. 4 and 5, and also all of the various other individual perforating blades previously described or to be described subsequently are well protected from the harmful actions of centrifugal forces and will be securely retained in the perforating blade holding strip 4.

Figure 7:
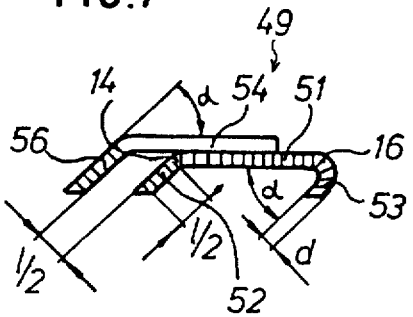
FIG. 7 is a top plan view of another individual perforating blade element in a view similar to that shown in FIG. 4.

In another preferred embodiment, as shown in FIG. 7, an individual perforating blade element, identified by 49 in its entirety, has a straight perforating segment 51, with angled perforating segments 52 and 53 angled at an angle α located on both of its ends 14, 16. In addition, a holding segment 54 of the same material extends parallel with the straight perforating segment 51 and has a second angled perforating segment 56 which is also angled at an angle α, and which extends parallel with the perforating segment 52 and is spaced therefrom at a distance of 0.5 times of a length "1". The length of each of the angled segments 52, 53 and 56 also approximately 0.5 times of a length "1" of the angled elements 17 and 18 of the previously discussed individual perforating blade elements 8 and 9. All of the angled perforating segments 52, 53, and 56 point in the direction of the plane 11 that is linearly bisecting the cylinder, as well as in the direction of rotation C of the perforating cylinder 1. These individual perforating blade elements 49 are provided in both right and left embodiments, wherein the angled segments of the individual perforating blade elements 49 respectively point in the direction of rotation C as well as the plane 11 linearly bisecting the cylinder and further wherein a center perforating blade element which is analogous to the individual perforating blade element 36 is arranged in the center. This type of center perforating blade elements 49 with the shortened, angled perforating segments lined up at a distance from each other is advantageously used for signatures with a relatively small number of, for example, up to 48 pages, and wherein a "short cut" is achieved with the short, angled perforating elements.

Figure 8:
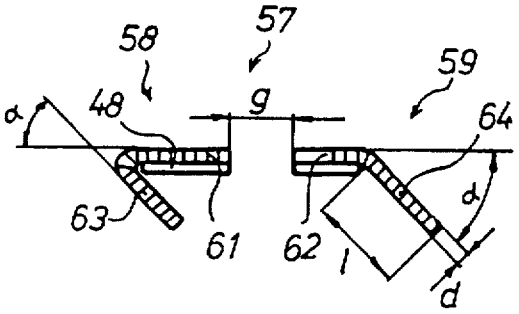
FIG. 8 is a top plan view of yet another individual perforating blade element.

In a further preferred embodiment, as may be seen in FIG. 8, an individual perforating blade element, identified by 57 in its entirety, is composed of several pieces and consists of two perforating sections 58 and 59 which are separated from each other at a distance "g" in a manner analogous to the perforating blade element 43, and which are oriented toward each other with their respectively straight, perforating segments 61 and 62 pointing in the direction of the axis of rotation of the perforating cylinder 1, while the angled perforating segments, designated by 63 and 64, and which are angled at the angle α respectively, point in the direction of the perforating cylinder 1 as well as in the direction of the plane 11 linearly bisecting the perforating cylinder 1. It is also possible to move the distance "g" of both angled sections 58, 59 toward zero, so that in this case an individual perforating blade element 8 or 9 is formed by this arrangement.

The straight perforating segments, for example 13, of the previously described individual perforating blade elements, for example 8, and 9, and 42 of the center perforating blade element 36 are clamped at a spacing distance "a" between the vertical T-leg 7 of the profiled blade holding strip 4 and the clamping strip 31, so that a perforating blade strip 3 is formed as seen in FIGS. 1 and 2. The thus adjustable, aligned individual perforating blade elements 8, 36 and 9 of the perforating blade strip 3 act against an elastic counter-strip, identified generally at 67 and as may be seen in FIG. 1, which is fastened in a cylinder trough 66 of the counter-perforating cylinder 21. The signature 19 is provided with a transverse perforation as it passes between the perforating blade strip 3, held in the perforating cylinder 1, and the counter strip 67.

Figure 9:
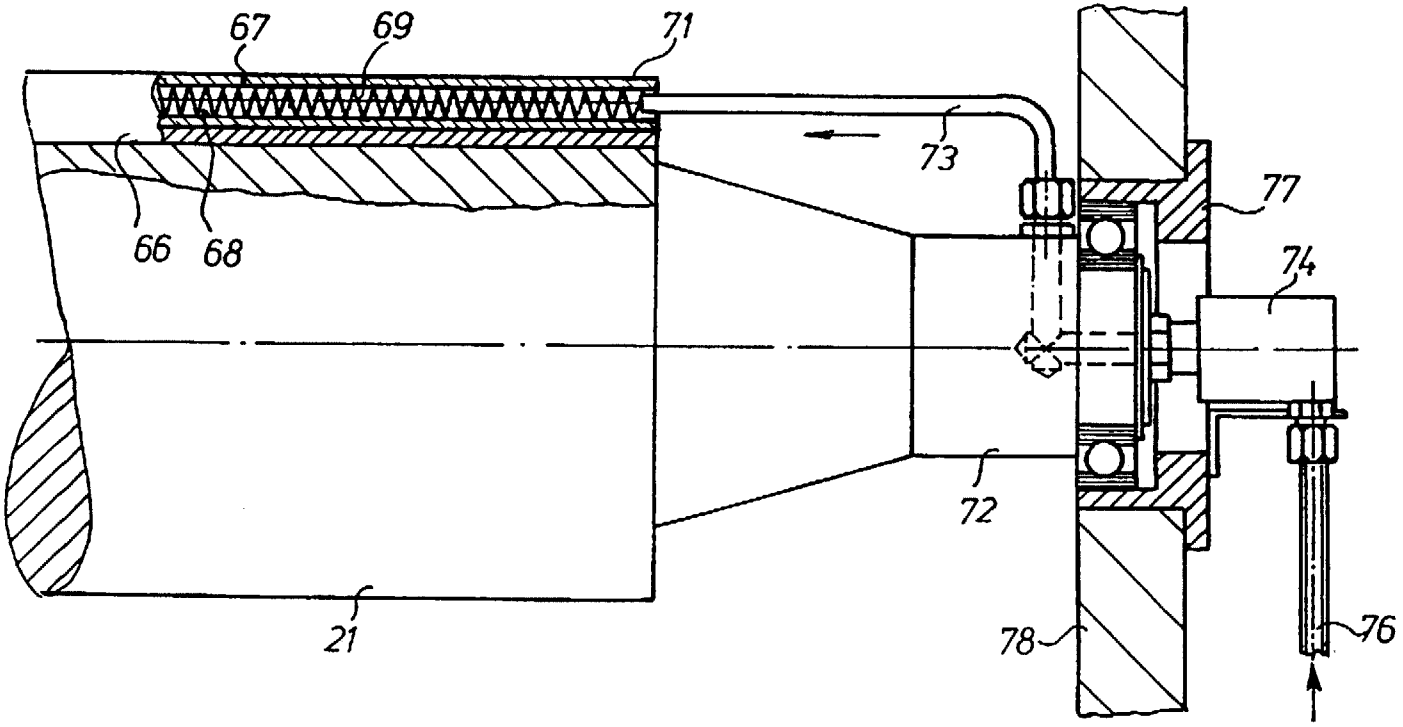
FIG. 9 is a side elevation view, partly in section of a portion of a counter-perforating cylinder and showing a counter strip with a compressed air feed.

The counter strip 67 can have a rectangular, and in particular a square cross section with a bore 68 extending in the axial direction with respect to the counter-perforating cylinder 21, as seen in FIG. 1. A cylindrical helical spring 69 extends over the entire length of the bore 68 and rests with its outer diameter against the diameter of the bore 68 as shown in FIGS. 1 and 9. This helical spring 69 has a length which is greater than the product of the number of turns and the wire diameter of the helical spring 69, so that the turns of the helical spring do not rest against each other. Compressed air is blown into the bore 68 from at least one end 71 of the bore 68. As is depicted in FIG. 9, the end 71 of the bore 68 is connected with a compressed air line 73 that is guided through the shaft journal 72 of the counter-perforating cylinder 21. The shaft journal 72 is provided with a known rotatable inlet 74, which is connected with a compressed air source 76. The rotatable inlet 74 is fastened on the lateral frame 78 of the press by means of a flange 77. It is also possible to design the counter strip 67 as a square hollow profile, in which the turns of the helical spring 69 partially rest on the inside of the hollow profile. The counter strip 67 is made of a hard, rubber-like, elastic material, for example plastic such as polyester polyol with a hardness of approximately 90 Shore A.

The operation of the signature perforating device for accomplishing the transverse perforation of signatures is as follows: in the course of operation of the folding apparatus the signatures 19 are transversely perforated between the perforating blade strip 3 and the counter strip 67, wherein the cutting edges, for example 22, 23 or 24 of the individual perforating blade elements, for example 8, and 9, and the cutting edges of the center perforating blade element 36 not only penetrate the paper webs of the signatures 19, but simultaneously penetrate the elastic counter strip 67 beyond their theoretical operational diameter until they end shortly in front of the clear bore 68. The missing piece between the penetration depth of the cutting edges 22, 23, 24 and the clear diameter of the bore 68 is worked open, i. e. becomes previous, because of the repeated entry of the cutting edges 22, 23 or 24 of the individual perforating elements 8, 36 or 9 into the counter strip 67 during each cylinder turn, so that paper dust being generated during signature perforation, passes through the turns of the cylindrical helical spring 69 located in the bore 68 and into the cylindrical hollow chamber within the turns, from where this paper dust is blown to the outside by means of compressed air introduced from the first end 71 of the helical spring 69 or the bore 68. It is of course also possible, to aspirate the paper dust at the second end of the helical spring 69 by means of vacuum through an analogous rotating inlet through the second shaft journal, also not shown.

While a preferred embodiment of a signature perforating device in accordance with the present invention has been set forth fully and completely hereinabove, it will be apparent to one of skill in the art that a number of changes in, for example, the overall sizes of the perforating and the counter-perforating cylinders, the drive assemblies for these cylinders, the type of rotary printing press being used and the like may be made without departing from the true spirit and scope of the present invention which is accordingly to be limited only by the following claims.

What is claimed is:

1. A signature perforating device comprising:

a perforating cylinder supported for rotation about a longitudinally directed axis of rotation;

a profiled blade holding strip positioned in said perforating cylinder and extending in said direction of said axis of rotation;

a blade clamping strip engageable with said profiled blade holding strip; and a plurality of perforating blades, each said perforating blade being individually held in said profiled blade holding strip, said plurality of perforating blades each having a straight perforating blade segment with first and second ends and with first and second angled perforating blade segments at said first and second ends, said first and second angled perforating blade segments being angled toward a plane linearly bisecting said perforating cylinder and pointing in a direction of rotation of said cylinder, said perforating blades including a plurality of individual perforating blade elements and a center perforating blade element, said plurality of individual perforating blade elements and said center perforating blade element being spaced from each other at a spacing distance in said longitudinal direction in said profiled blade holding strip, said straight perforating blade segments of said plurality of individual perforating blade elements and of said center perforating blade element forming perforations in a signature with said spacing distances leaving bars between the perforations formed in a signature.

2. The signature perforating device of claim 1 further including a third angled perforating blade segment disposed at said first end and spaced from said first angled perforating blade segment.

3. The signature perforating device of claim 1 wherein each said straight perforating blade segment is comprised of first and second straight blade sections which are spaced from each other.

4. The signature perforating device of claim 1 wherein each said straight perforating blade segment is comprised of first and second end sections having said first and second ends and a center section, said end sections being spaced from said center section.

5. The signature perforating device of claim 1 wherein said perforating blades are arranged symmetrically in respect to said linear plane.

6. The signature perforating device of claim 1 wherein said perforating blades are arranged asymmetrically in respect to said linear plane.

7. The signature perforating device of claim 1 wherein each of said perforating blades has finely toothed cutting edges.

8. The signature perforating device in accordance with claim 1 wherein said profiled blade holding strip is generally in the shape of an inverted T having a head portion and a leg with a groove in said leg of said inverted T, and further wherein each of said perforating blades has a tongue with a bead, said bead being receivable in said groove when said perforating blades are held in said profiled blade holding strip.

* * * * *